US009242366B2

(12) United States Patent
Liu

(10) Patent No.: US 9,242,366 B2
(45) Date of Patent: Jan. 26, 2016

(54) HAND TOOL WITH AN ANGLE ADJUSTING MECHANISM

(71) Applicant: Chao-Chih Liu, Taichung (TW)

(72) Inventor: Chao-Chih Liu, Taichung (TW)

( * ) Notice: Subject to any disclaimer, the term of this patent is extended or adjusted under 35 U.S.C. 154(b) by 246 days.

(21) Appl. No.: 14/074,716

(22) Filed: Nov. 8, 2013

(65) Prior Publication Data

US 2015/0128770 A1 May 14, 2015

(51) Int. Cl.
*B25G 3/38* (2006.01)
*B25G 1/06* (2006.01)

(52) U.S. Cl.
CPC *B25G 3/38* (2013.01); *B25G 1/063* (2013.01); *B25G 1/066* (2013.01)

(58) Field of Classification Search
CPC ..... B25G 3/38; B25G 1/063; B25G 1/066
See application file for complete search history.

(56) References Cited

U.S. PATENT DOCUMENTS 6,000,302 A * 12/1999 Chiang ..... B25G 1/063 81/177.7
6,216,317 B1 * 4/2001 Chen ..... B25G 1/063 16/430
6,216,567 B1 * 4/2001 Hu ..... B25G 1/063 81/177.6
6,557,442 B1 * 5/2003 Owoc ..... B25G 1/063 81/177.8
6,848,345 B2 * 2/2005 Lin ..... B25G 1/063 403/91
6,957,600 B2 * 10/2005 Hu ..... B25G 1/063 81/177.7
7,171,875 B2 * 2/2007 Hu ..... B25G 1/063 81/177.6
7,735,399 B2 * 6/2010 Robinson ..... B25G 1/06 81/177.8
8,850,932 B2 * 10/2014 Tsai ..... B25B 13/461 81/177.7
2004/0144217 A1 * 7/2004 Hu ..... B25G 1/063 81/177.8
2004/0144218 A1 * 7/2004 Hu ..... B25G 1/063 81/177.8
2005/0051004 A1 * 3/2005 Chen ..... B25G 1/063 81/177.8
2008/0141833 A1 * 6/2008 Shen ..... B25G 1/063 81/61
2011/0072941 A1 * 3/2011 Tsai ..... B25G 1/063 81/177.8

* cited by examiner

*Primary Examiner* — David B Thomas

(57) ABSTRACT

A hand tool with an angle adjusting mechanism includes a handle, a tool head, a controlling rod and an engaging member. The handle has a receiving groove defined at one end thereof, a transverse hole defined in one lateral side and a longitudinal hole defined in a bottom of the receiving groove. The tool head has a pivoting portion assembled in the receiving groove of the handle. The pivoting portion has a low of teeth defined at an outer periphery thereof. The controlling rod is disposed in the transverse hole of the handle. The engaging member has a post and an engaging head. The engaging head has an inner tooth part and two side teeth disposed at opposite sides of the inner tooth part. The inner tooth part and the side teeth form a substantially concave shape to engage with the teeth of the pivoting portion.

6 Claims, 9 Drawing Sheets

HAND TOOL WITH AN ANGLE ADJUSTING MECHANISM

BACKGROUND OF THE INVENTION

1. Field of the Invention

The present invention relates to a hand tool and more particularly to a hand tool with an angle adjusting mechanism, in which an angle between a handle and a head member pivoted on the handle is adjustable.

2. Description of Related Art

A conventional hand tool with an angle adjusting mechanism comprises a handle, a tool head, a positioning assembly and a rotating member. The handle has a receiving space defined therein for received the positioning assembly and a threaded hole communicating with the receiving space for assembling with the rotating member. The positioning assembly comprises a spring and an abutting member. The spring abuts against a bottom of the receiving space and the abutting member with two ends. The abutting member is protruded from the receiving space with one end and engaged with the tool head resiliently. The rotating member has a positioning post extend from one end thereof. The positioning post of the rotating member screws into the threaded hole of the handle to adjust the abutting member to engage or disengage with the tool head. Therefore, an angle of the tool head relative to the handle could be adjusted.

However, the conventional hand tool with the angle adjusting mechanism has disadvantages as following: The abutting member is engaged with the tool head only one tooth so that the abutting member cannot secure the tool head steadily. In addition, the respective tooth of the tool head will be worn easily.

The present invention has arisen to mitigate and/or obviate the disadvantages of the conventional hand tool.

SUMMARY OF THE INVENTION

The main objective of the present invention is to provide an improved hand tool.

To achieve the objective, a hand tool with an angle adjusting mechanism, comprises a handle having two pivot ears defined at one end thereof, a receiving groove defined between the two pivot ears, a transverse hole defined in one lateral side thereof and an longitudinal hole defined in a bottom of the receiving groove, the longitudinal hole communicating with the transverse hole; a tool head having a pivoting portion received in the receiving groove of the handle, the tool head assembled with the two pivot ears by a pivot shaft passing through, the pivoting portion having a row of teeth formed at an outer periphery thereof and arranged in an arc; a controlling rod being movable in the transverse hole of the handle, the controlling rod defining a recess corresponding to the longitudinal hole and an inclined plane sloped toward the recess; an engaging member having a post extending through the longitudinal hole of the handle and an engaging head corresponding to the arc teeth face of the pivoting portion, the inclined plane of the controlling rod abutting against the post, the engaging head having an inner tooth part defined at a top side thereof and two side teeth disposed at opposite sides of the inner tooth part; and a spring disposed in the longitudinal hole of the handle and mounted around the post of the engaging member, the spring having a diameter larger than a width of the inner tooth part.

Under this arrangement, the inner tooth part and the two side teeth form a substantially concave shape to engage with the teeth of the pivoting portion.

Further benefits and advantages of the present invention will become apparent after a careful reading of the detailed description with appropriate reference to the accompanying drawings.

DETAILED DESCRIPTION OF THE INVENTION

Figure 1:
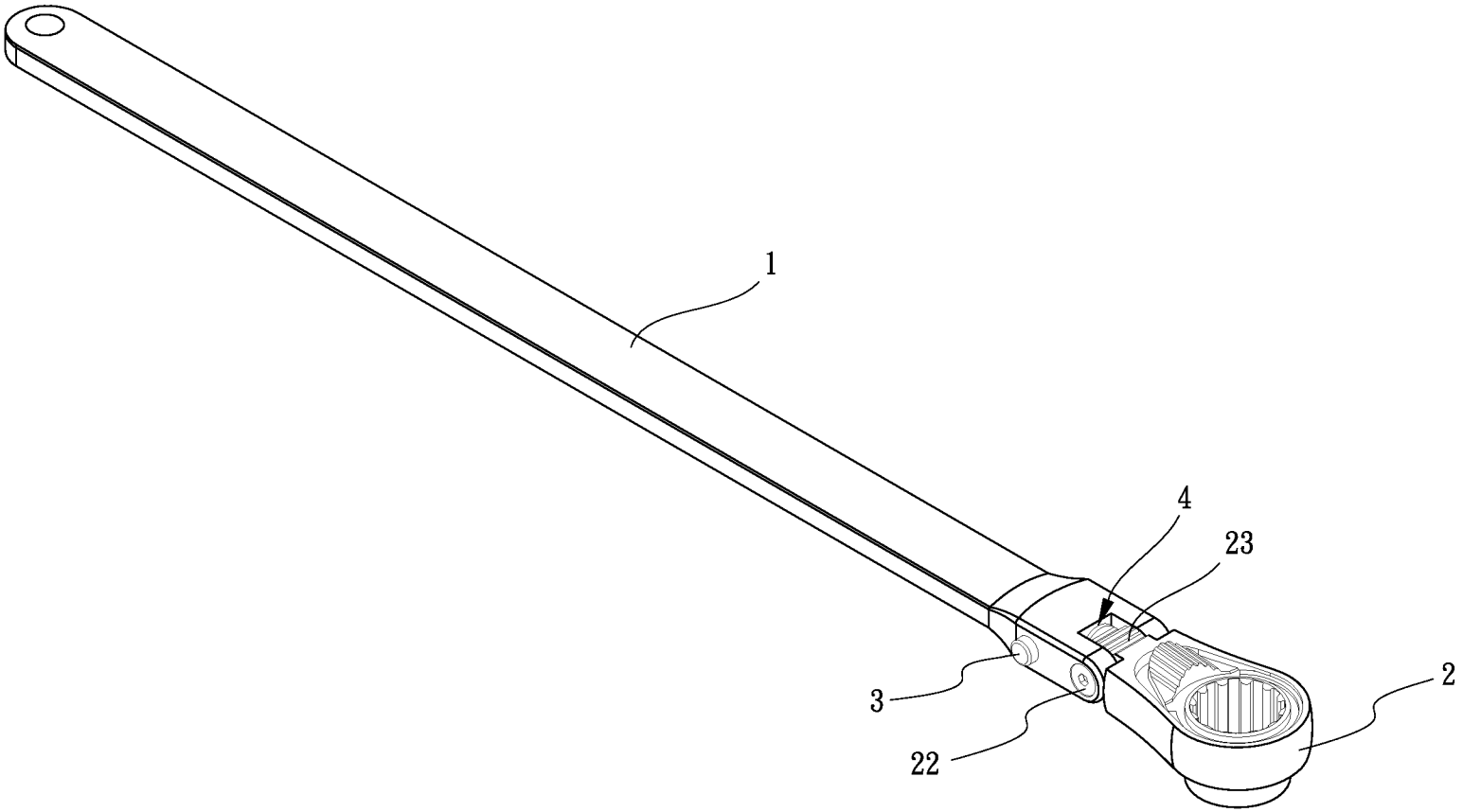
FIG. 1 is a perspective view of a hand tool with an angle adjusting mechanism of the present utility model.
Figure 2:
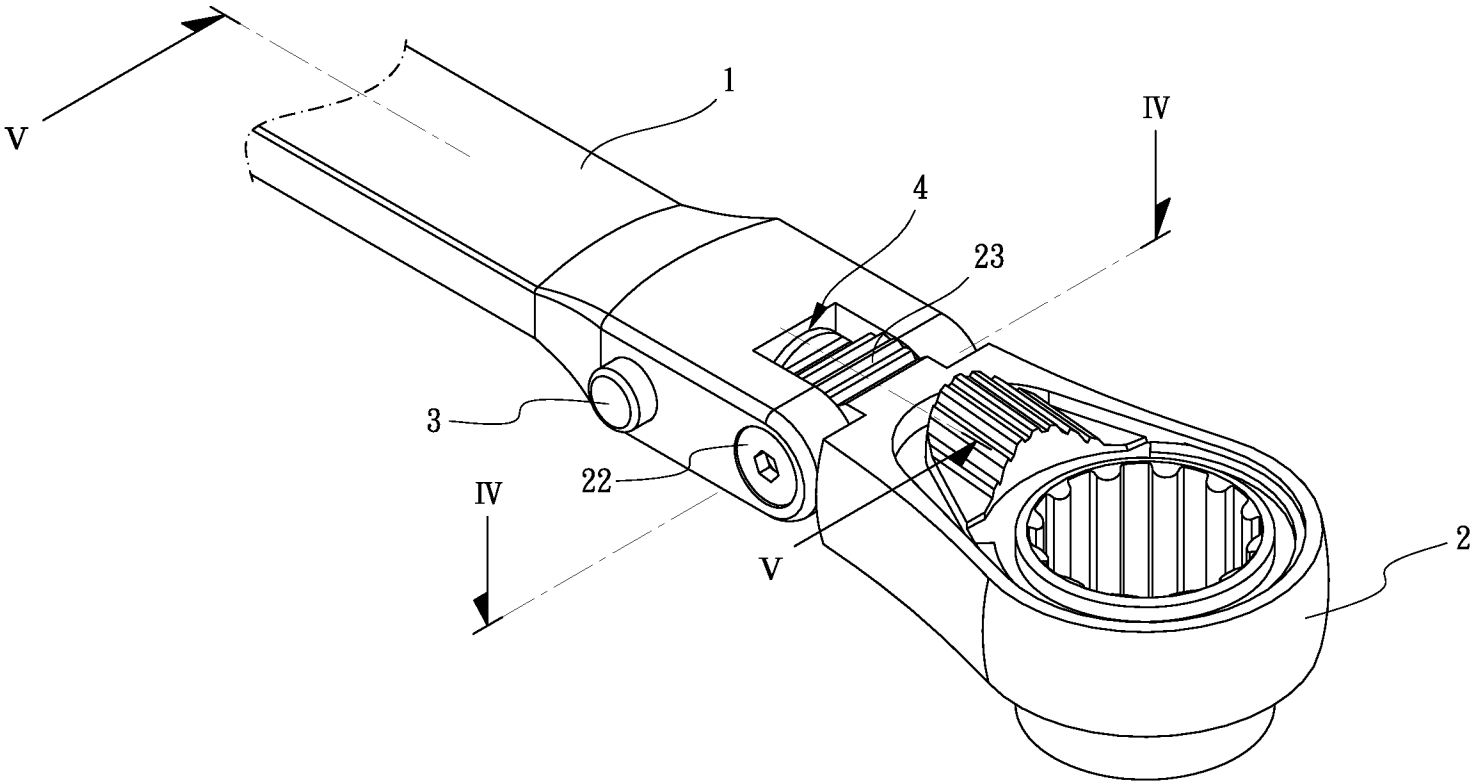
FIG. 2 is an enlarged view of the hand tool with the angle adjusting mechanism of FIG. 1.

Referring to FIGS. 1-5, a hand tool with an angle adjusting mechanism in accordance with the present invention comprises a handle 1, a tool head 2, a controlling rod 3 and an engaging member 4. The handle 1 has two pivot ears 11, 12 defined at one end thereof and a receiving groove 13 defined between the two pivot ears 11, 12. The handle 1 further has a transverse hole 14 defined in one lateral side near the respective pivot ear 11 and an longitudinal hole 15 defined in a bottom of the receiving groove 13 of the handle 1. The longitudinal hole 15 communicates with the transverse hole 14 of the handle 1. The tool head 2 has a pivoting portion 21 defined at one end thereof and received in the receiving groove 13. A pivot shaft 22 passes through the two pivot ears 11, 12 and the pivoting portion 21 of the tool head 2 so that the tool head 2 could be pivoted relative to the handle 1. The pivoting portion 21 has a low of teeth 23 defined at an outer periphery thereof and arranged in an arc.

The controlling rod 3 is movable in the transverse hole 14 of the handle 1. The controlling rod 3 has a recess 31 corresponding to the longitudinal hole 15 and an inclined plane 32 sloped toward the recess 31. The engaging member 4 has a post 41 extends through the longitudinal hole 15 of the handle 1 and an engaging head 42 corresponding to the teeth 23 of the pivoting portion 21. The inclined plane 32 of the controlling rod 3 abuts against the post 41 of the engaging member 4. The engaging head 42 of the engaging member 4 has an inner tooth part 43 defined at a top side thereof and two side teeth 44 disposed at opposite sides of the inner tooth part 43, so that the inner tooth part 43 is disposed between the two side teeth 44. In a preferred embodiment, the inner tooth part 43 has two teeth. Specifically, the two side teeth 44 are higher than the inner tooth part 43 so as to form a substantially concave shape and engage with the teeth 23 of the pivoting portion 21. In addition, a spring 50 is disposed in the longitudinal hole 15 of the handle 1 and mounted around the post 41 of the engaging member 4, wherein the spring 50 has a diameter larger than a width L of the inner tooth part 43 so as to abut against the engaging head 42 steadily, as shown in FIG. 5.

Under this arrangement, the two side teeth 44 and the inner tooth part 43 are shaped as a substantially concave so as to fit the teeth 23 of the pivoting portion 21. Therefore, the inner tooth part 43 and the two side teeth 44 of the engaging head 42 are fully engaged with the teeth 23 of the pivoting portion 21 so as to retain the tool head 2 on the handle 1. Furthermore, the two side teeth 44 of the engaging head 42 are configured to further abut against the teeth 23 of the pivoting portion 21 so as to prevent the inner tooth part 43 from abrasion.

Figure 3:
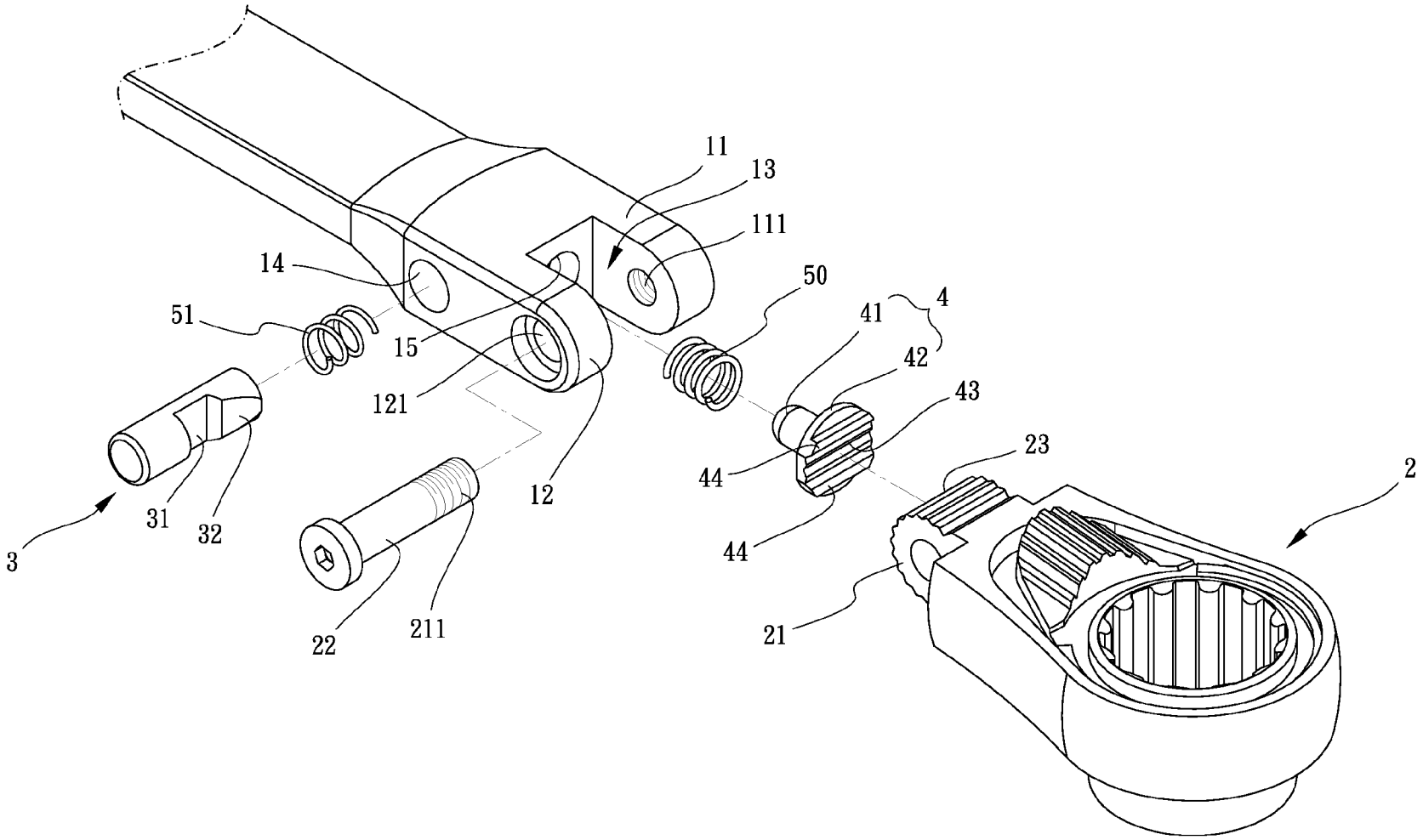
FIG. 3 is an exploded perspective view of the hand tool with the angle adjusting mechanism of FIG. 2.
Figure 4:
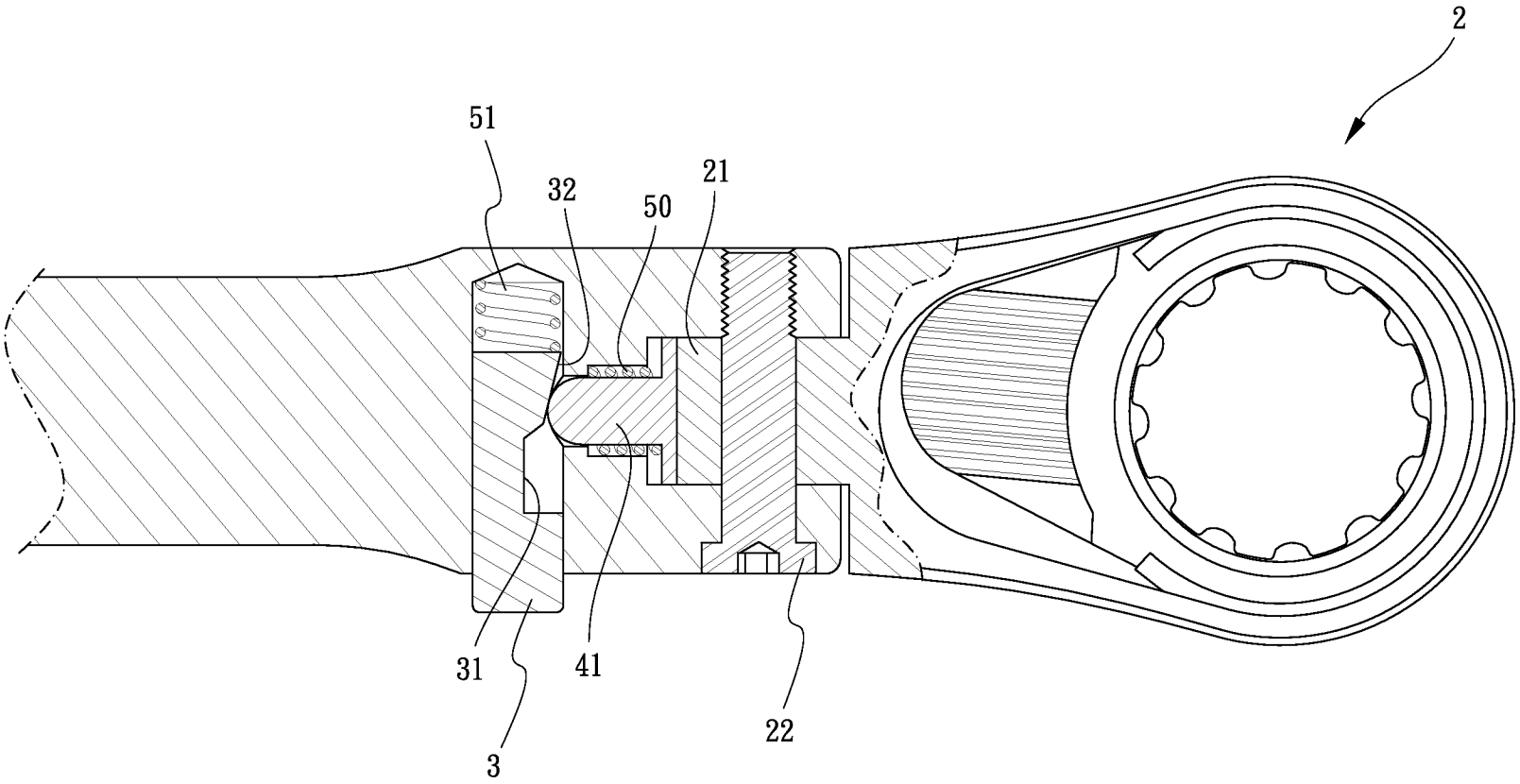
FIG. 4 is a cross-sectional view of the hand tool with the angle adjusting mechanism along line IV-IV of FIG. 2.
Figure 5:
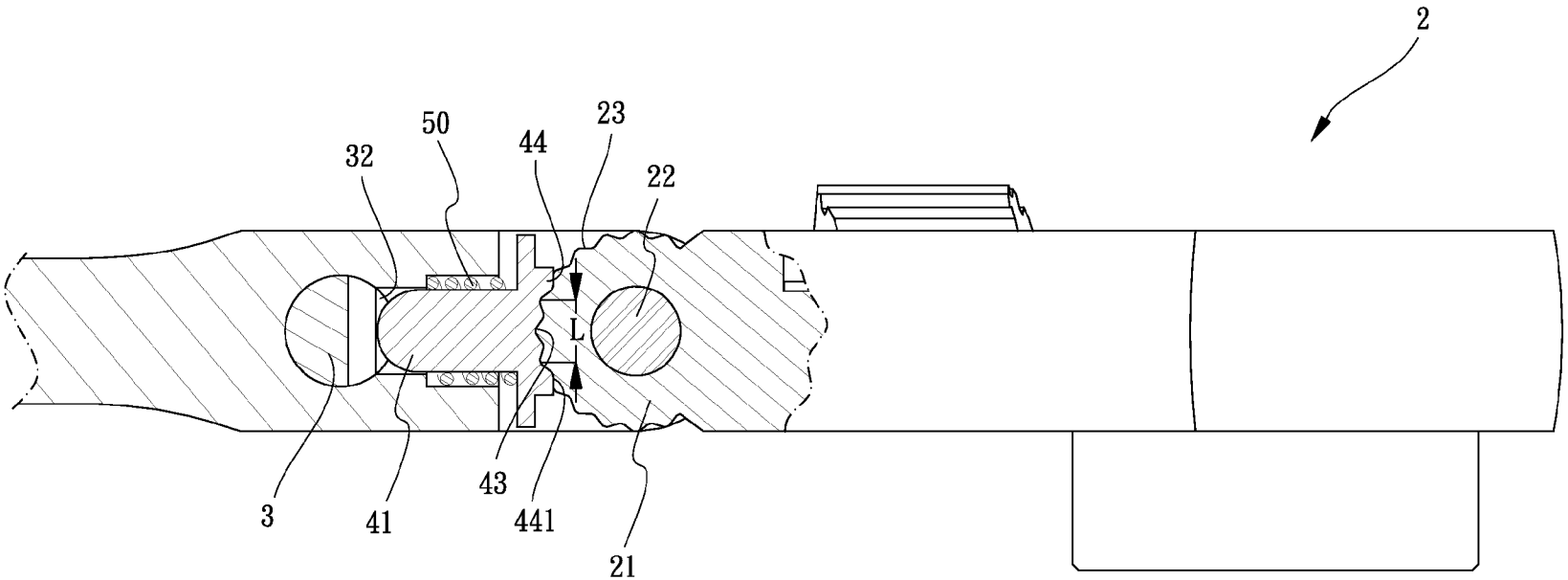
FIG. 5 is a cross-sectional view of the hand tool with the angle adjusting mechanism along line V-V of FIG. 2.

Referring to FIG. 5, the inner tooth part 43 and the two side teeth 44 are fully engaged with the teeth 23. In particular, each of the two sided teeth 44 has an abutting face 441 defined at a top side thereof which abuts against a respective one of the teeth 23, wherein the abutting face 441 is a horizontal plane. As shown in FIG. 4 and referring to FIG. 3, an elastic member 51 is disposed in the transverse hole 14 of the handle 1 and biased between the controlling rod 3 and a bottom of the transverse hole 14. Also, the spring 50 is biased between a bottom of the longitudinal hole 15 and the engaging head 42 of the engaging member 4.

Moreover, the longitudinal hole 15 of the handle 1 defines a large-diameter hole (not numbered) at one end and a small-diameter hole (not numbered) at the other end. The spring 50 is received in the large-diameter hole and abutted against a shoulder (not numbered) between the large-diameter hole and the small-diameter hole with one end. Therefore, the spring 50 is disposed in the longitudinal hole 15 steadily so that the engaging member 4 is moved smoothly. Referring to FIGS. 3-4, one of the pivot ears 12 has a through hole 121 defined therein and the other pivot ear 11 has a threaded hole 111 defined therein. The pivot shaft 22 has a threaded section 221 defined at one end thereof which corresponds to the threaded hole 111 of the pivot ear 11. The pivot shaft 22 passes through the through hole 121 of the respective pivot ear 12 and the pivoting portion 21 and screws into the threaded hole 111 of the respective pivot ear 11 via the threaded section 221 of the pivot shaft 22 so as to assemble the tool head 2 with the handle 1.

Figure 6:
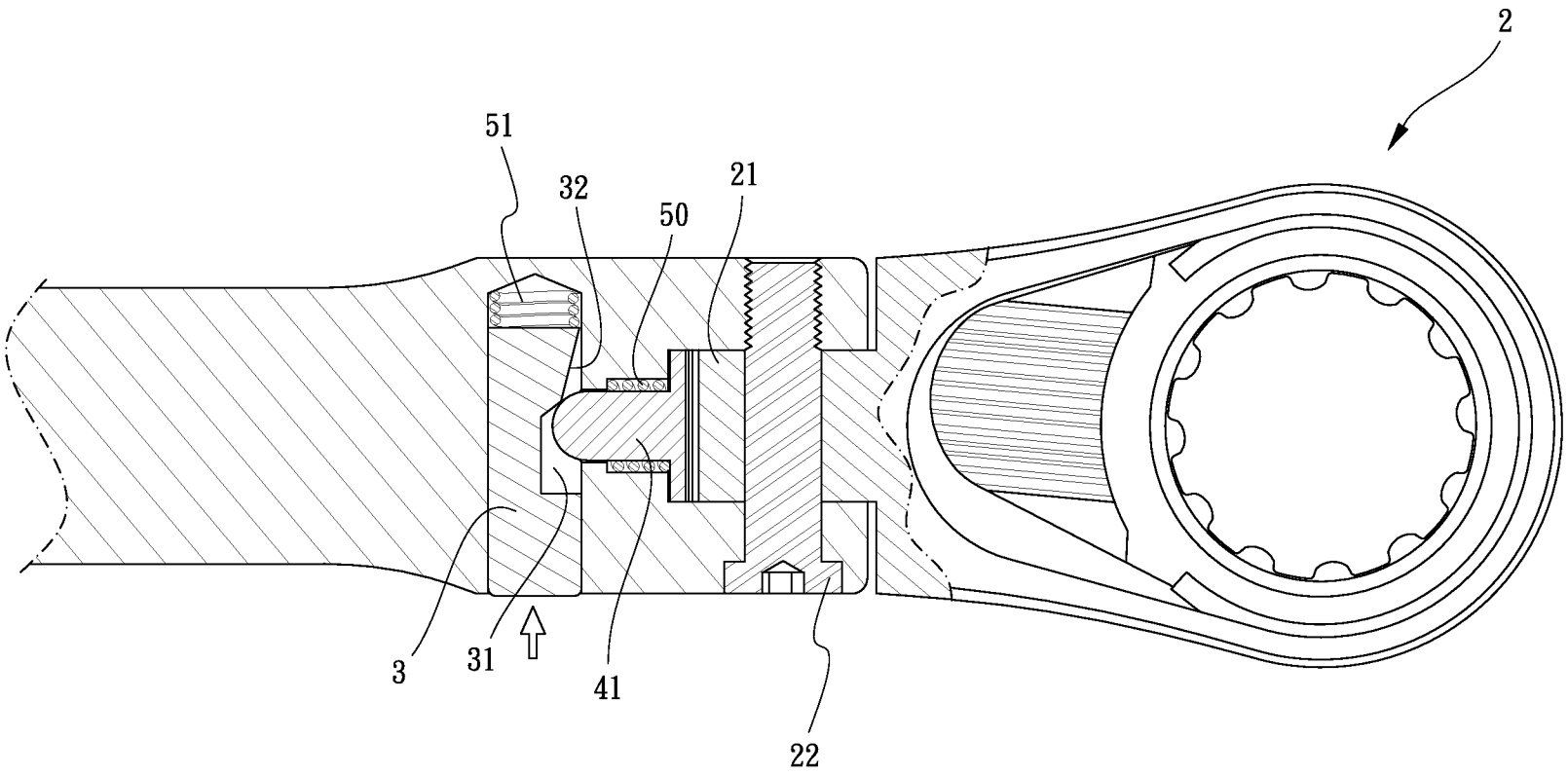
FIGS. 6-8 illustrate that a tool head is adjusted relative to a handle.
Figure 7:
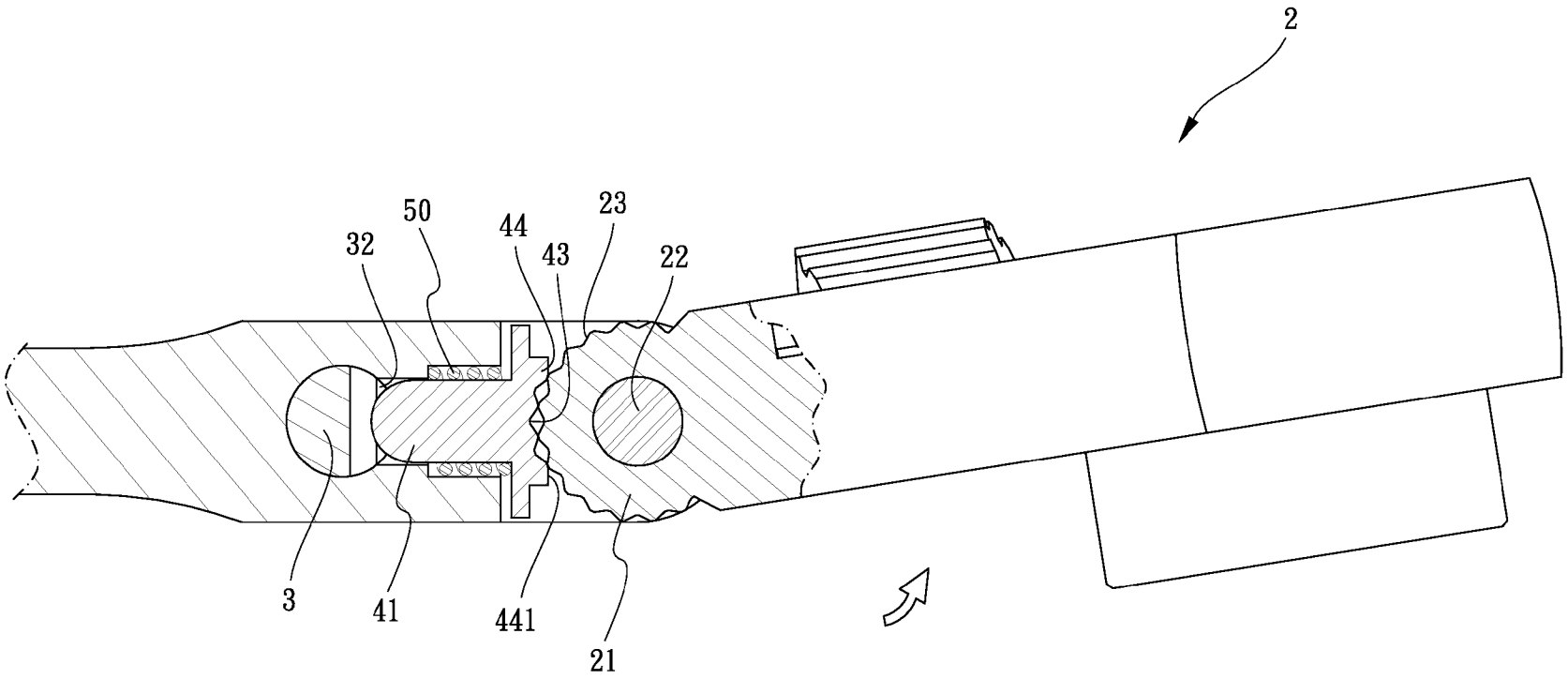
Figure 8:
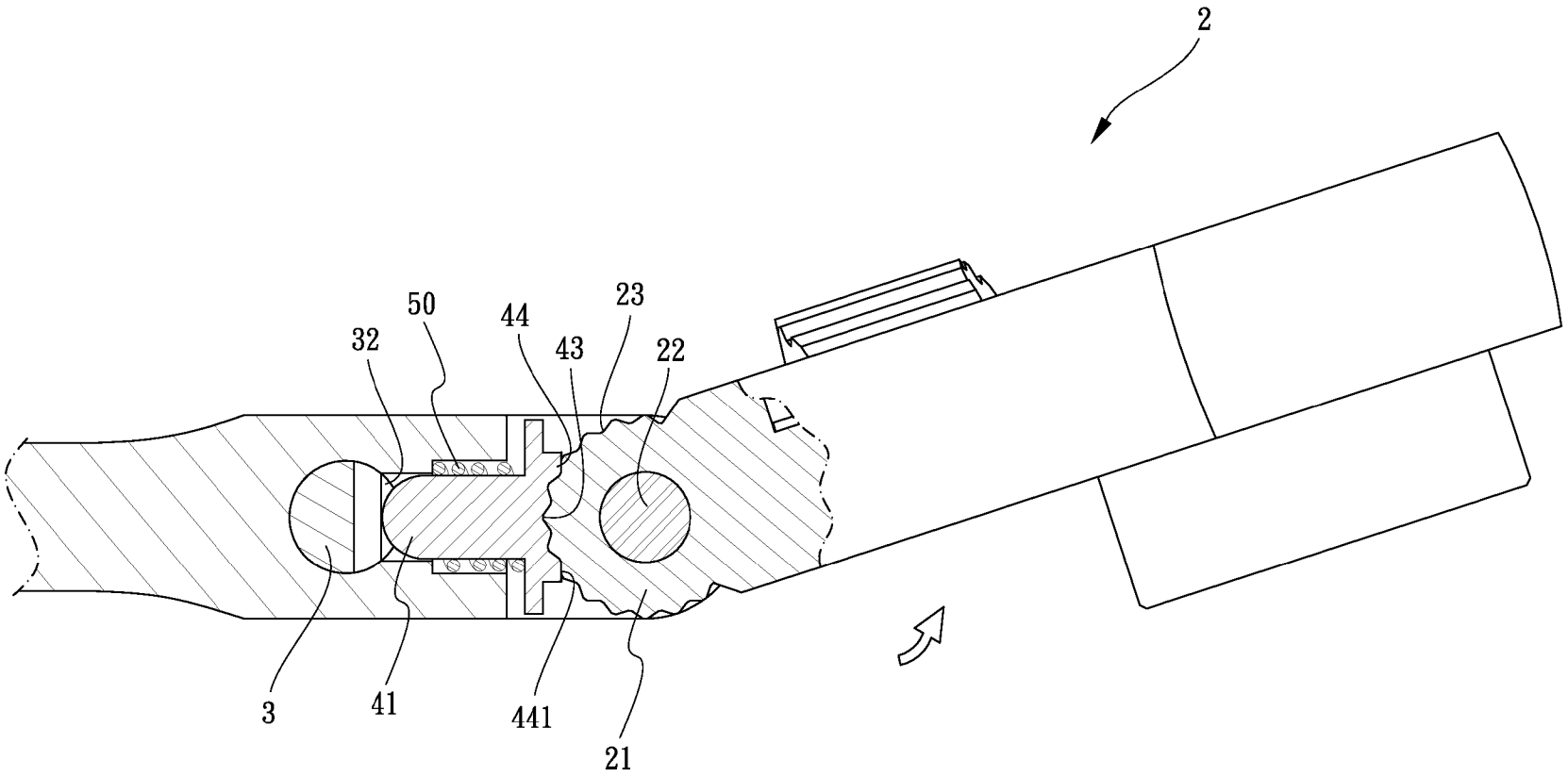

The detail descriptions of the operation are shown as following. Generally, the inclined plane 32 of the controlling rod 3 is abutted against the post 41 of the engaging member 4 so as to secure the tool head 2, as shown in FIG. 4. FIGS. 6-8 illustrate the operation for adjusting an angle of the tool head 2 relative to the handle 1. When the controlling rod 3 is pushed to compress the elastic member 51, the tool head 2 could be rotated relative to the handle 1; simultaneously the engaging member 4 could be drawn back into recess 31 so as to disengage with the teeth 23 of the pivoting portion 21 temporary. Therefore, the angle of the tool head 2 could be adjusted relative to the handle 1. In contrast, when the controlling rod 3 is released, the inclined plane 32 of the controlling rod 3 is abutted against the post 41 of the engaging member 4 again via a recovery force of the elastic member 51. Therefore, the inner tooth part 43 and the two side teeth 44 are engaged with the teeth 23 so as to retain the tool head 2 in a certain angle.

Figure 9:
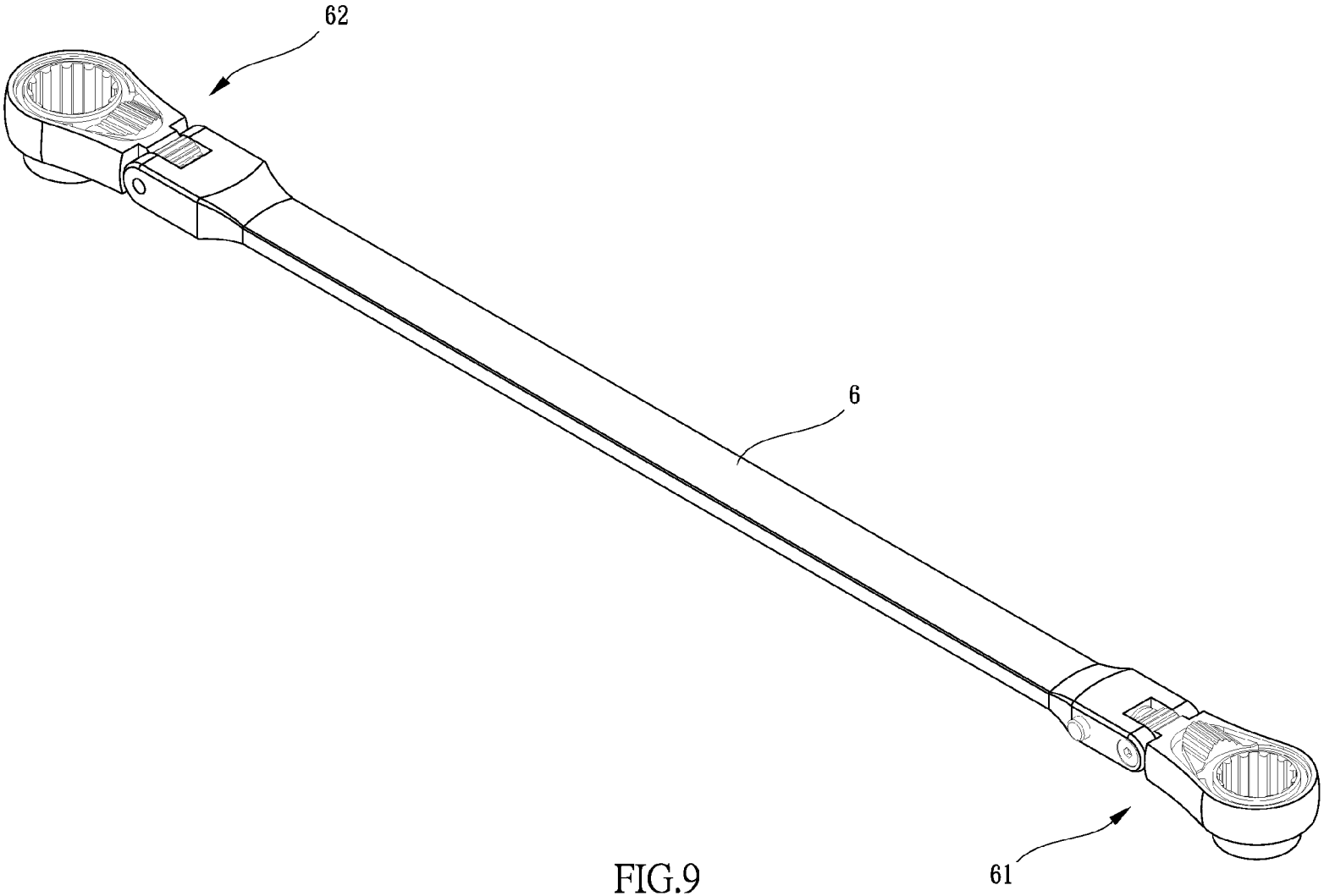
FIG. 9 illustrates that the handle assembled with two tool heads at two ends.

Referring to FIG. 9, there is shown another embodiment of the present invention, which is similar to above embodiment; except that a handle 6 is assembled with two tool head 61, 62 at two ends of the handle 6, wherein the two head 61, 62 could be rotated relative to the handle 6.

Although the invention has been explained in relation to its preferred embodiment, it is to be understood that many other possible modifications and variations can be made without departing from the scope of the invention as hereinafter claimed.

What is claimed is:

1. A hand tool with an angle adjusting mechanism, comprising:

a handle having two pivot ears defined at one end thereof, a receiving groove defined between the two pivot ears, a transverse hole defined in one lateral side thereof and an longitudinal hole defined in a bottom of the receiving groove, the longitudinal hole communicating with the transverse hole;

a tool head having a pivoting portion received in the receiving groove of the handle, the tool head assembled with the two pivot ears by a pivot shaft passing through, the pivoting portion having a row of teeth formed at an outer periphery thereof and arranged in an arc;

a controlling rod being movable in the transverse hole of the handle, the controlling rod defining a recess corresponding to the longitudinal hole and an inclined plane sloped toward the recess;

an engaging member having a post extending through the longitudinal hole of the handle and an engaging head corresponding to the arc teeth face of the pivoting portion, the inclined plane of the controlling rod abutting against the post, the engaging head having an inner tooth part defined at a top side thereof and two side teeth disposed at opposite sides of the inner tooth part, the two side teeth being higher than the inner tooth part to form a substantially concave shape so that the inner tooth part and the two side teeth of the engaging head are engaged with the teeth of the pivoting portion, each of the two side teeth having an abutting face defined at a top side thereof, each abutting face being a horizontal plane which abuts against one of the teeth of the pivoting portion corresponding thereto; and a spring disposed in the longitudinal hole of the handle and mounted around the post of the engaging member, the spring having a diameter larger than a width of the inner tooth part;

wherein, the inner tooth part and the two side teeth form a substantially concave shape to engage with the teeth of the pivoting portion.

2. The hand tool with the angle adjusting mechanism as claimed in claim 1, further comprising an elastic member disposed in the transverse hole of the handle and biased between the controlling rod and a bottom of the transverse hole.

3. The hand tool with the angle adjusting mechanism as claimed in claim 1, wherein the longitudinal hole of the handle defines a large-diameter hole at one end and a small-diameter hole at the other end.

4. The hand tool with the angle adjusting mechanism as claimed in claim 3, wherein the spring is received in the large-diameter hole and abuts against a shoulder between the large-diameter hole and the small-diameter hole with one end.

5. The hand tool with the angle adjusting mechanism as claimed in claim 1, wherein one of the pivot ears has a through hole defined therein and the other pivot ear has a threaded hole defined therein, and the pivot shaft has a threaded section defined at one end thereof.

6. A hand tool with an angle adjusting mechanism, comprising:

a handle having two pivot ears defined at one end thereof, a receiving groove defined between the two pivot ears, a transverse hole defined in one lateral side thereof and an longitudinal hole defined in a bottom of the receiving groove, the longitudinal hole communicating with the transverse hole;

a tool head having a pivoting portion received in the receiving groove of the handle, the tool head assembled with the two pivot ears by a pivot shaft passing through, the pivoting portion having a row of teeth formed at an outer periphery thereof and arranged in an arc;

a controlling rod being movable in the transverse hole of the handle, the controlling rod defining a recess corresponding to the longitudinal hole and an inclined plane sloped toward the recess;

an engaging member having a post and an engaging head which is connected to a first end of the post, a second end of the post extending through the longitudinal hole of the handle, the engaging head completely located in the receiving groove between the two pivot ears and corresponding to the arc teeth face of the pivoting portion, the inclined plane of the controlling rod abutting against the post, the engaging head having an inner tooth part defined at a top side thereof and two side teeth disposed at opposite sides of the inner tooth part, the two side teeth being higher than the inner tooth part to form a substantially concave shape so that the inner tooth part and the two side teeth of the engaging head are engaged with the teeth of the pivoting portion, each of the two side teeth having an abutting face defined at a top side thereof, each abutting face being a horizontal plane which abuts against one of the teeth of the pivoting portion corresponding thereto; and a spring disposed in the longitudinal hole of the handle and mounted around the post of the engaging member, the spring having a diameter larger than a width of the inner tooth part;

wherein, the inner tooth part and the two side teeth form a substantially concave shape to engage with the teeth of the pivoting portion.

* * * * *